US006607350B2

(12) United States Patent
Dodd

(10) Patent No.: US 6,607,350 B2
(45) Date of Patent: Aug. 19, 2003

(54) GAS TURBINE ENGINE SYSTEM

(75) Inventor: Alec G Dodd, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 10/105,197

(22) Filed: Mar. 26, 2002

(65) Prior Publication Data

US 2003/0012644 A1 Jan. 16, 2003

(30) Foreign Application Priority Data

Apr. 5, 2001 (GB) ..... 0108527

(51) Int. Cl.[7] ..... F01D 11/16
(52) U.S. Cl. ..... 415/14; 415/126; 415/173.2
(58) Field of Search ..... 415/14, 126, 173.1, 415/173.2, 221

(56) References Cited

U.S. PATENT DOCUMENTS 3,520,635 A * 7/1970 Killmann et al. ..... 415/138
4,330,234 A * 5/1982 Colley ..... 415/173.2
4,343,592 A * 8/1982 May ..... 415/173.2
5,203,673 A 4/1993 Evans

FOREIGN PATENT DOCUMENTS

GB 2 042 646 A 9/1980

* cited by examiner

*Primary Examiner*—Ninh H. Nguyen
(74) *Attorney, Agent, or Firm*—Warren Taltavull; Manelli Denison & Selter PLLC

(57) ABSTRACT

Tip clearance apparatus for a gas turbine engine comprises a shroud ring having curved portions so as to allow eccentric offset and hence asymmetric movement of the shroud. The shroud ring is mounted within a guide also having corresponding curved portions and movement of the shroud ring is controlled by the use of sensors.

6 Claims, 2 Drawing Sheets

GAS TURBINE ENGINE SYSTEM

This invention relates to a rotor tip clearance apparatus for a gas turbine engine. More particularly but not exclusively this invention relates to a turbine rotor tip clearance apparatus for a gas turbine engine.

Control of clearance variations between gas turbine rotors and their adjacent static structures is essential in the design of efficient gas turbine engines. One area where this is particularly relevant is the gap or seal between a turbine rotor blade and its associated static shroud structure. Centrifugal and thermal loads affect this clearance and various prior solutions have been proposed in order to minimise changes in the clearance.

It is now well known to use active clearance control (A.C.C) to maintain minimum tip clearance throughout use of the engine. One such proposed use of active clearance control is disclosed in our previous patent GB 2 042 646B. This prior invention proposes the use of a plurality of rotatable eccentrics mounted so as to move the annular shroud axially and hence control the clearance between the shroud and rotors. A probe is mounted in an aperture within the engine casing and projects into the clearance thus sensing changes in the size of the clearance (through sensing) pressure changes, which are fed into a control system.

A need has been identified, however for an improved tip clearance control system which is based on the general arrangement disclosed in GB 2042646.

According to the present invention there is provided rotor tip clearance apparatus for a gas turbine engine comprising an annular shroud member being attached to a hollow support ring supported within a guide member, said member having an internal frustoconical face adapted to cooperate with the outer extremities of the rotor to define a clearance therewith, said support ring being controllable so as to alter the clearance between the shroud member and the outer extremities of said rotor wherein said support ring comprises curved portions adapted to cooperate with curved portions in said guide member so as to allow asymmetric movement of said shroud member.

The invention will now be described by way of example, with reference to the accompanying drawings in which.

Figure 1:
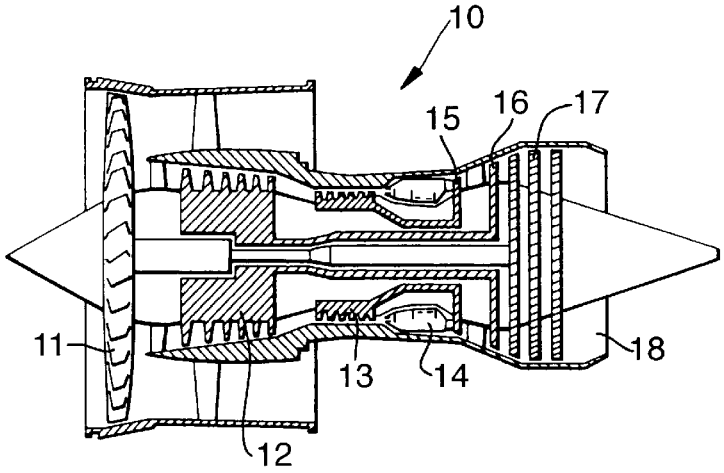
FIG. 1 is a schematic sectioned view of a ducted gas turbine engine, which incorporates a rotor blade tip clearance apparatus in accordance with the present invention.

With reference to FIG. 1, a ducted gas turbine engine shown at 10 is of a generally conventional configuration. It comprises in axial flow series a fan 11, intermediate pressure compressor 12, high pressure compressor 13, combustion equipment 14 and turbine equipment 15, 16 and 17. The turbine equipment comprises high, intermediate and low pressure turbines 15, 16 and 17 respectively and an exhaust nozzle 18. Air is accelerated by the fan 11 to produce two flows of air, the larger of which is exhausted from the engine 10 to provide propulsive thrust. The smaller flow of air is directed into the intermediate pressure compressor 12 where it is compressed and then directed into the high pressure compressor where further compression takes place. The compressed air is then mixed with the fuel in the combustion equipment 14 and the mixture combusted. The resultant combustion products then expand through the high, intermediate and low pressure turbines 15, 16 and 17 respectively before being exhausted to atmosphere through the exhaust nozzle 18 to provide additional propulsive thrust.

Figure 2:
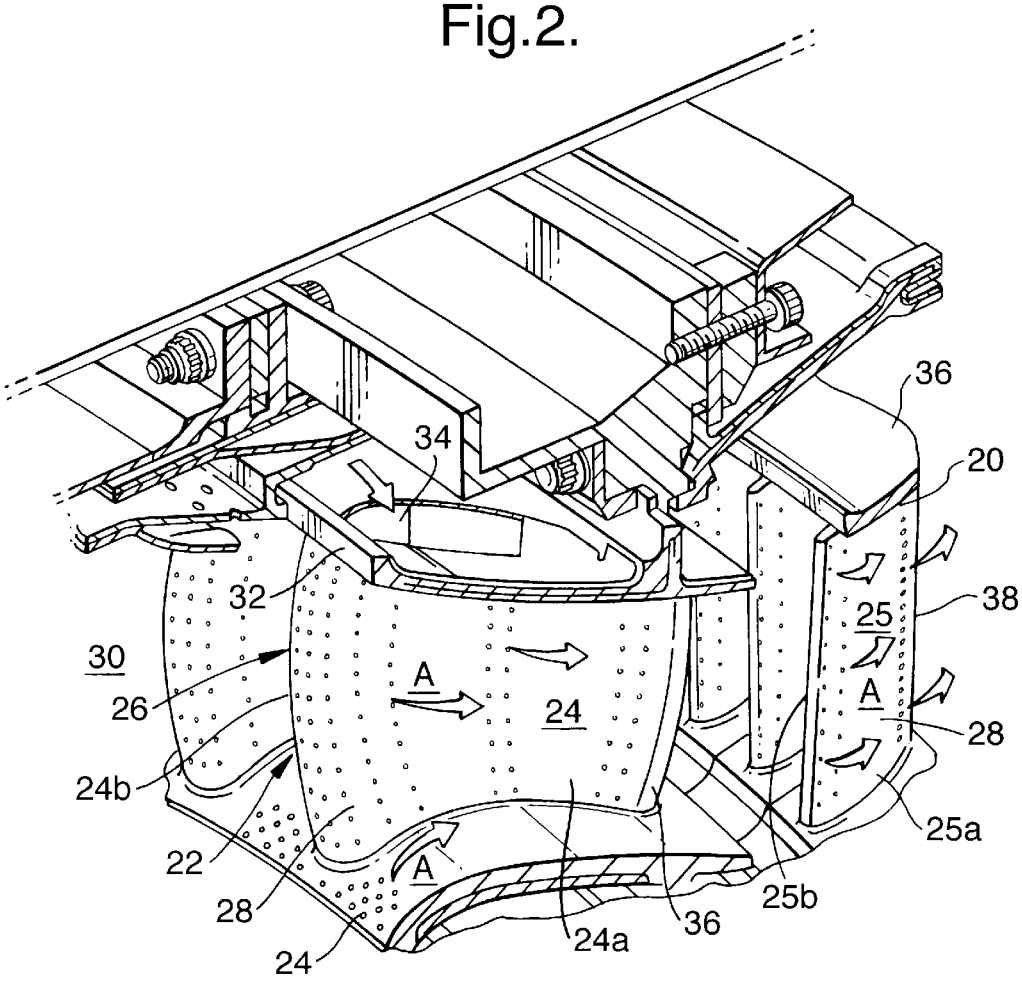
FIG. 2 is a view of a nozzle guide vane and turbine blade arrangement of the gas turbine engine shown in FIG. 1.

Now referring to FIG. 2 in which the high pressure turbine 15 of the gas turbine engine is shown in a partial broken away view. The high pressure turbine 15 includes an annular array of similar radially extending air cooled aerofoil turbine blades 20 located upstream of an annular array of aerofoil nozzle guide vanes 22. The remaining turbine 16 and 17 are provided with several more axially extending alternate annular arrays of nozzle guide vanes and turbine blades, however these are not shown in FIG. 2 for reasons of clarity.

The nozzle guide vanes 22 each comprise a radially extending aerofoil portion 24 so that adjacent aerofoil portions 24 define convergent generally axially extending ducts 26. The turbine blades 20 also comprise an aerofoil portion 25. The vanes 22 are located in the turbine casing in a manner that allows for expansion of the hot air from the combustion chamber 14. Both the nozzle guide vanes 22 and turbine blades 20 are cooled by passing compressor delivery air through them to reduce the effects of high thermal stresses and gas loads. Arrows A indicate the flow of this cooling air. Cooling holes 28 provide both film cooling and impingement cooling of the nozzle guide vanes and turbine blades.

In operation hot gases flow through the annular gas passage 30. These hot gases act upon the aerofoil portions 25 of the turbine blades 20 to provide rotation of the turbine disc (not shown) upon which the blades 20 are mounted. The gases are extremely hot and internal cooling of the vanes 22 and the blades 20 is necessary. Both the vanes 22 and the blades 20 are hollow in order to achieve this and in the case of vanes 22 cooling air derived from the compressor is directed into their radially outer extents through apertures 32 formed within their radially outer platforms 34. The air then flows through the vanes 22 to exhaust therefrom through a large number of cooling holes 28 provided in the aerofoil portion 24 into the gas stream flowing through the annular gas passage 30.

At their outer extremities the blades 20 run close to an annular shroud 36. The clearance between the rotor blade 20 and the shroud 36 is important to the overall efficiency of the engine. It is therefore desirable to maintain this clearance as small as possible without closing completely.

Figure 3:
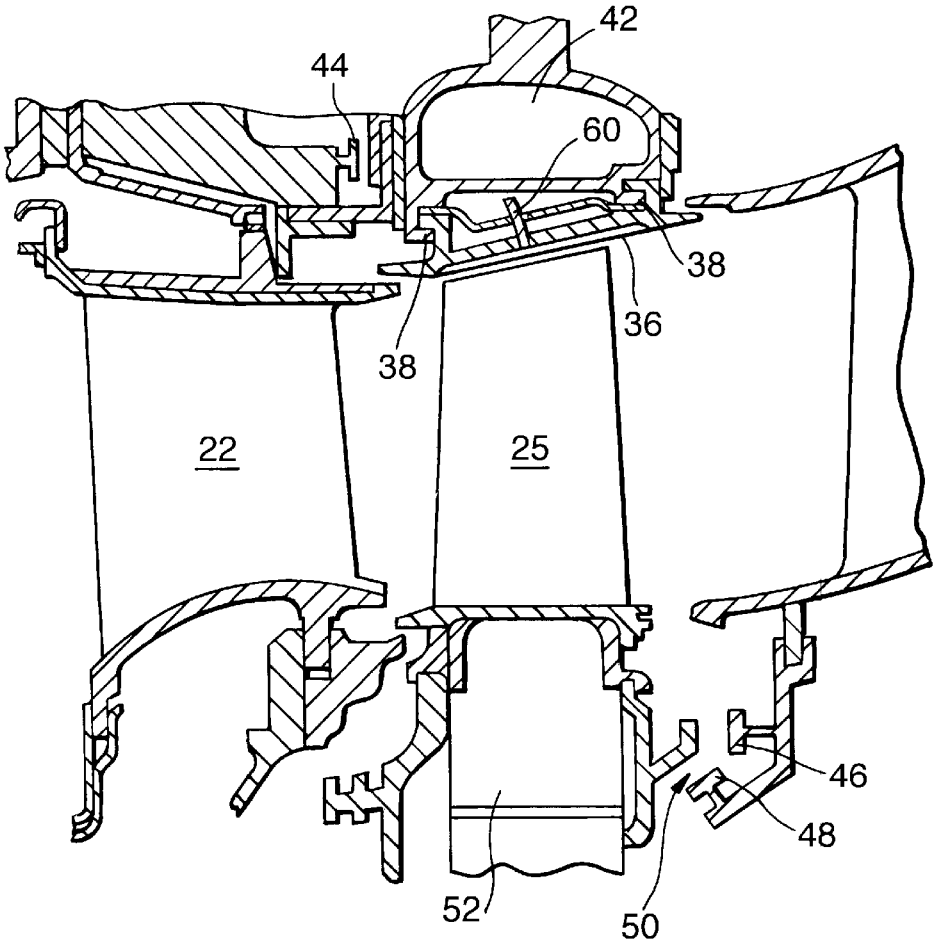
FIG. 3 is an enlarged section through the nozzle guide vane and turbine blade arrangement of FIG. 2.
Figure 4:
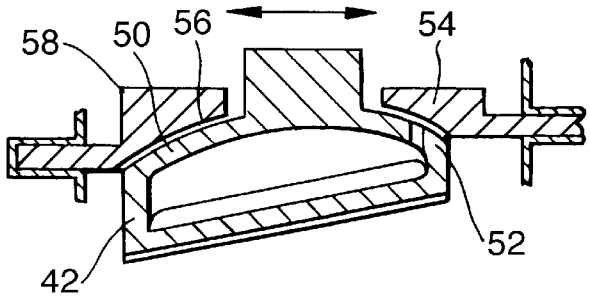
FIG. 4 is section view of an enlarged portion of FIG. 3.

Referring now to FIG. 3 the shroud 36 is carried by hook shaped engagements 38 which protrude from a hollow shroud ring 42. The shroud ring 42 is of generally rectangular cross section. A plurality of eccentrics (not shown) provides a location for the shroud ring 42. These eccentrics allow radial expansion of the ring 42 under thermal stresses and are linked to an actuating unison ring (not shown). This unison ring is connected to the control system and moved when necessary to vary the clearance between the shroud ring 42 and the blade 20 tip. The general arrangement of the unison ring and eccentrics is wholly disclosed in prior patent GB 2 042 646 B which is incorporated herein by reference. However the shroud ring 42 of the present invention is advantageously partly curved as shown in FIG. 4 which enables it to be mounted in an offset manner with respect to the blade 20 tip. Curved portions 50 and 52 are mounted in corresponding curved portion 54, 56 of mounting guide 58. Although the shroud ring 42 operates in the same manner as that disclosed in prior patent GB 2 042 646B, the offset mounting of the shroud ring 42 of the present invention allows asymmetric movement of the shroud ring 42 to compensate for such movements of the blade 20 tip. This asymmetric deflection of the shroud ring 42 to compensate for asymmetric deflection of engine parts allows rapid accommodation of transient movements without loss of efficiency.

A number of sensors 44, 46, 48 are provided to measure the clearance between the blades 20 and the shroud ring 42. The sensors 48 and 46 are mounted so as to monitor movement of the disk 52. Sensor 44 monitors movement of the shroud ring 42. Sensor 48 is mounted so as to be parallel to the shroud 36 hence providing an accurate measurement of movement of the shroud. Although in this embodiment of the invention these sensors are capacitance probes any suitable sensors may be employed.

The three sensors 44, 46, 48 feed their measurement information into a logical control system. The control system can therefore calculate the expected position of the blade tip using the measurements from sensors 44, 46 and 48 to amend its prediction if necessary. Since sensor 48 is parallel to the blade tip the measurement fed into the control system requires less processing hence alleviating the previously required adjustment of axial movement to a trimming signal.

A further sensor 60 may also be provided to allow closed loop control of the system.

I claim:

1. Rotor tip clearance apparatus for a gas turbine engine comprising an annular shroud member attached to a hollow support ring supported within a guide member, said member having an internal frustoconical face adapted to cooperate with the outer extremities of the rotor to define a clearance therewith, said support ring being controllable so as to alter the clearance between the shroud member and the outer extremities of said rotor wherein said support ring comprises curved portions adapted to cooperate with curved portions in said guide member so as to allow asymmetric movement of said shroud member.

2. Rotor tip clearance apparatus as claimed in claim 1 further comprising at least one sensor arranged to measure the clearance between the rotor outer extremities and the shroud member.

3. Rotor tip clearance apparatus as claimed in claim 1 wherein at least one sensor is mounted parallel to the shroud member.

4. Rotor tip clearance apparatus as claimed in claim 1 wherein at least one sensor is mounted adjacent the tip of said shroud member so as to measure axial movement of said shroud member.

5. Rotor tip clearance apparatus as claimed in claim 1 wherein said support ring is substantially hemispherical.

6. Rotor tip clearance apparatus as claimed in claim 1 wherein a logical control system is provided to receive information from said sensors and calculate the expected position of the rotor outer extremities.

* * * * *